US005460302A

United States Patent [19]

Foraker

[11] Patent Number: 5,460,302

[45] Date of Patent: Oct. 24, 1995

[54] GARMENT SUPPORT FOR PACKING CLOTHES

[76] Inventor: Chet Foraker, 45 Meadowbrook La., Trophy Club, Tex. 76262

[21] Appl. No.: 188,595

[22] Filed: Jan. 31, 1994

Related U.S. Application Data

[63] Continuation-in-part of Ser. No. 52,470, Apr. 26, 1993, abandoned.

[51] Int. Cl.[6] ..... A41H 33/00; A41D 27/22

[52] U.S. Cl. ..... 223/37; 223/89; 223/94

[58] Field of Search ..... 223/66, 68, 69, 223/84, 85, 95, 94, 89, 37, 38, DIG. 3

[56] References Cited

U.S. PATENT DOCUMENTS

| | | | |
|---|---|---|---|
| 830,874 | 9/1906 | Bedinger | 223/85 |
| 952,202 | 3/1910 | Klingenfeld | 223/89 |
| 1,181,691 | 5/1916 | Stiebritz | 223/85 |
| 1,258,476 | 3/1918 | Severance | 223/89 |
| 1,861,274 | 5/1932 | Hopkins | 223/37 |
| 1,866,150 | 7/1932 | Books | 223/94 |
| 2,058,217 | 10/1936 | Dixon | 223/85 |
| 2,383,009 | 8/1945 | Meyer | 223/85 |
| 2,498,373 | 2/1950 | Marsand | 223/85 |
| 2,761,599 | 9/1956 | Lancaster | 223/DIG. 3 |
| 2,856,110 | 10/1958 | Cowan | 223/89 |
| 2,983,415 | 5/1961 | Cooley | 223/95 |
| 3,405,854 | 10/1968 | Blair | 223/85 |
| 3,584,746 | 6/1971 | Marchman | 223/85 |
| 3,643,841 | 2/1972 | Rhindress | 223/95 |
| 3,695,492 | 10/1972 | Sheba | 223/94 |
| 4,186,858 | 2/1980 | Tatematsu | 223/94 |
| 4,580,705 | 4/1986 | Wolfson et al. | 223/85 |
| 4,932,571 | 6/1990 | Blanchard | 223/89 |

FOREIGN PATENT DOCUMENTS

| | | | |
|---|---|---|---|
| 952530 | 3/1964 | United Kingdom | 223/85 |

*Primary Examiner*—Clifford D. Crowder
*Assistant Examiner*—Bibhu Mohanty
*Attorney, Agent, or Firm*—John F. Bryan, Jr.

[57] ABSTRACT

A folding frame assembly having an open upper frame and a hingedly attached open lower frame provides spaced parallel bars for supporting the folded portions of a pair of pants and a separately folded suit coat and furthermore, provides the upper frame with shoulder support bars sloping at an included angle of between one hundred and one hundred twenty degrees so that the sides of the coat skirt hang and fold within the width of the shoulders.

16 Claims, 5 Drawing Sheets

GARMENT SUPPORT FOR PACKING CLOTHES

This is a continuation-in-part of application Ser. No. 08/052,470, filed on Apr. 26, 19993, now abandoned.

TECHNICAL FIELD

This invention relates to apparatus for holding garments in a compact and substantially wrinkle-free manner when packed as in a suitcase.

BACKGROUND AND SUMMARY OF THE INVENTION

Packing garments such as suits and the like has long been a problem, and the ability to carry an unwrinkled spare business suit in a small bag would be particularly welcome to the contemporary traveler. Garment bags and partitioned suitcases are the only means available to meet this need, but neither provides a truly satisfactory way to pack garments for traveling without wrinkling, and neither is particularly compact. If a garment is packed, any looseness allows wrinkles which soon become unsightly creases. A garment bag might be adequate if it could be kept separate, hanging vertically, and never folded but, even so, only a bare minimum of clothing could be packed without wrinkling. A traveler coping with the realities of extended trips and baggage handling is not permitted such luxuries. Partitioned suitcases, where a garment is folded on, or under a hinged partition, are also ineffective. When a garment is packed in this manner, the bulky, multiple layers of fabric bunch together, allowing loose folds, which become creases by the end of the trip. Neither garment bags nor suitcases are provided with positive supporting means for holding a garment flat. To the contrary, where conventional wire clothes hangers have shoulder support bars which are angled downwardly at thirty degrees, the captive clothes hangers used in luggage have relatively square shoulder bars. This conserves packing space but causes the skirt of a suit coat or jacket to flare and wrinkle rather than hang straight and fold flat.

Cowan, U.S. Pat. No. 2,856,110, discloses a garment support in the form of a three part hinged panel. A suit coat or jacket and pair of trousers, placed on a wire hanger in the conventional manner, ie. with the trousers folded across the cross bar of the hanger, inside of the coat, is laid on the panel and folded together with the panel. The skirt of the jacket is held between two parts of the hinged panel, and to that extent, the garment is better supported than if simply folded over a partition. Bulky, multiple layers of fabric are folded however, just as when a garment is folded over a hinged partition. Further, Cowan does not address flaring and wrinkling of the jacket skirt.

A first object of the present invention therefore, is to provide apparatus for folding garments flat so as to be compactly packed for traveling. A second object is to support the garments so as to maintain the flat condition and prevent wrinkling when packed and a third object is to provide this apparatus as a complete, self contained unit, which can be packed in virtually any traveling bag.

Accordingly, the present invention comprises an open frame which allows flat folding and refolding of trousers or a skirt while providing rigid support for each folded portion thereof and, furthermore, provides a frame for similar flat folding and supporting a suit coat or jacket over the folded trousers or skirt. The layers of fabric in a fold are thus reduced to a minimum and each portion of a suit or garment is held securely ill a flat position so that it cannot shift or wrinkle in packing.

Where it has become accepted practice to have a shoulder bar angle of thirty degrees (an included angle of one hundred twenty degrees) in conventional closet clothes hangers and less in luggage, the inventor has found that flat folding of a jacket is facilitated by a somewhat greater angle. Thirty degrees allows a suit coat or jacket to hang with the skirt unwrinkled and the front buttoned, as is desirable in a closet. A somewhat greater angle of approximately thirty-five degrees (an included angle of one hundred ten degrees) will allow the left and right sides of the skirt to overlap and the shoulders of the sleeves to rotate forward so that the jacket will fold flat more readily. While this improvement is not essential to the practice of the invention, results are improved thereby.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE INVENTION

Figure 1:
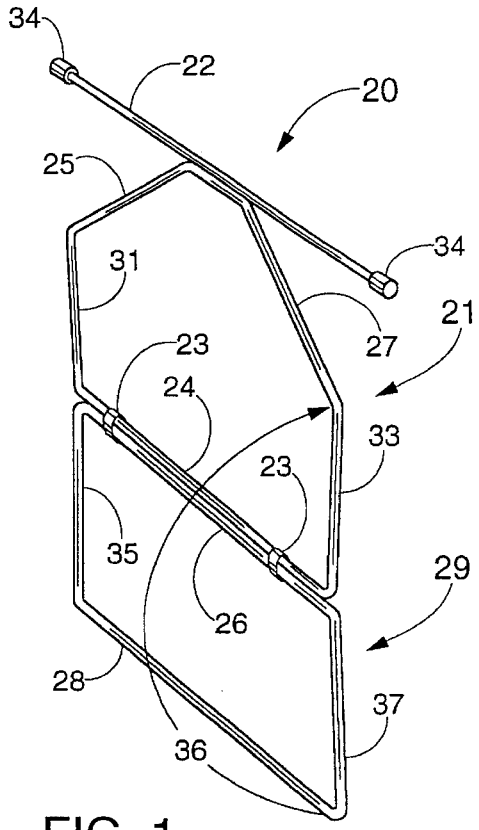
FIG. 1 shows a preferred embodiment of the present invention.

In FIG. 1, the preferred embodiment 20 of the apparatus for supporting folded and refolded garments of the present invention is shown to comprise open upper frame 21 and open lower frame 29. Upper frame 21 includes a straight first upper bar 22 and a parallel first lower bar 24 of approximately the same length. The dimensions of both the upper frame 21 and the lower frame 29 are related to the garments to be supported as is later discussed. Right and left shoulder support bars 25 and 27 respectively, depend symmetrically from first upper bar 22, forming an angle of approximately thirty-five degrees therewith, and bend to form upper frame side bars 31 and 33 which join with the first lower bar 24 at approximate right angles. End caps 34 are fitted to the ends of first upper bar 22 to avoid the potential of damage to a garment. Lower frame 29 includes second upper bar 26 and the parallel second lower bar 28 of approximately the same length as first bars 22 and 24. Lower frame side bars 35 and 37 join second bars 26 and 28 at approximately right angles, making lower frame 29 a continuous, generally rectangular part. Loops 23, which may be of nylon or any other suitable material, are fitted around first lower bar 24 and second upper bar 26 to form a hinged attachment which allows second lower bar 28 to rotate about first lower bar 24 as is indicated by arrow 36.

Figure 2:
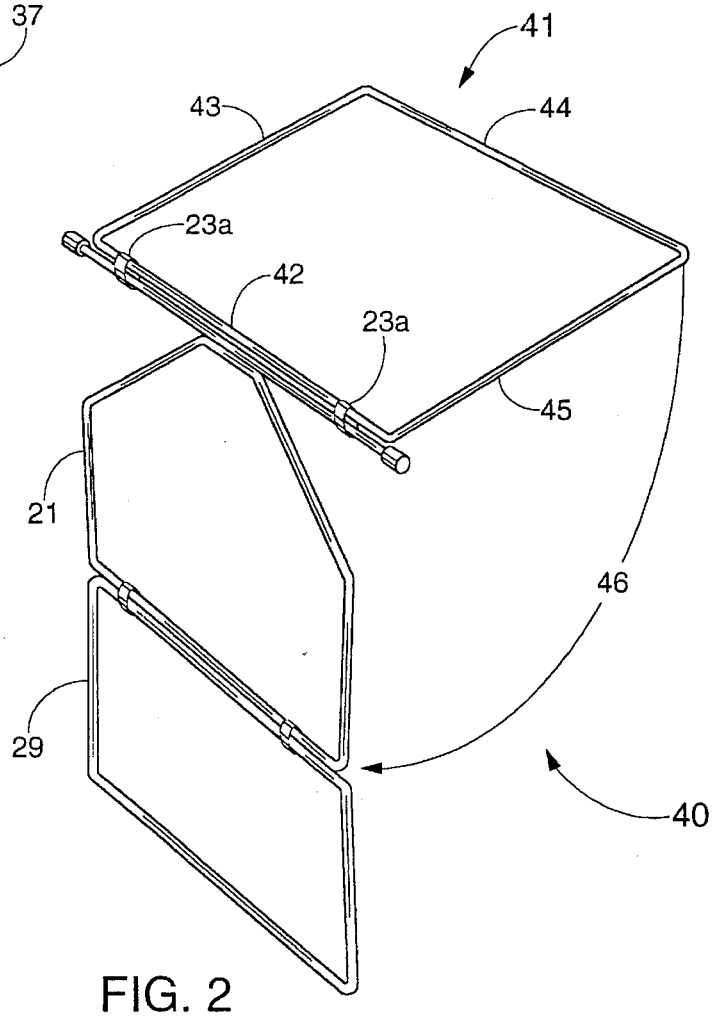
FIG. 2 shows a second preferred embodiment of the present invention.

In FIG. 2, a second preferred embodiment 40 of the present invention is shown to comprise upper frame 21 and lower frame 29 of preferred embodiment 20 with the addition of auxiliary frame 41. The added auxiliary frame 41 includes a third upper bar 42 and a parallel third lower bar 44 of approximately the same length and spacing as first bars 22 and 24. Preferably the third lower bar 44 should be spaced to fall slightly below first lower bar 24 when folded down. Upper frame side bars 43 and 45 join with third upper bar 42 and third lower bar 44 at approximate right angles to form the substantially rectangular perimeter of auxiliary frame 41. Similar to loops 23 of preferred embodiment 20, loops **23*a* are fitted around first upper bar 22 and third upper bar 42, forming a hinged attachment of auxiliary frame 41 for rotation about first upper bar 22 as indicated by arrow 46**.

Figure 3:
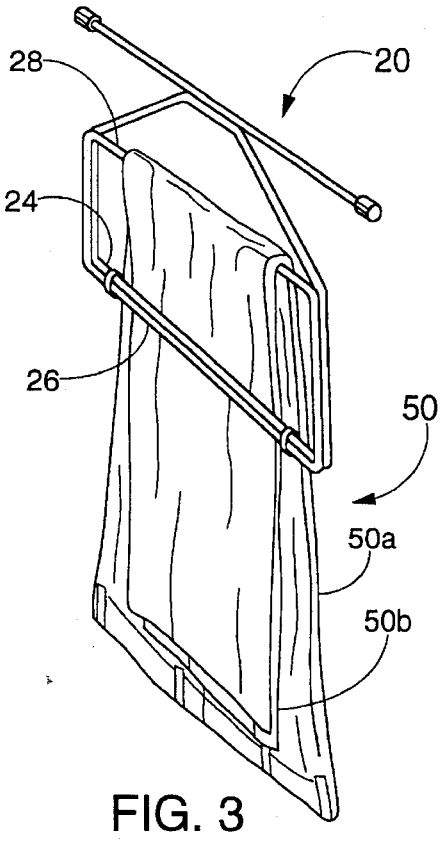
FIG. 3 shows the first step of placing a pair of pants on the preferred embodiment of FIG. 1.

FIG. 3 shows the first step of folding a garment 50, which may be either a skirt or the pair of pants shown in this illustration. Second lower bar 28 is first rotated to the uppermost position as shown. Then, starting in the flat, fully extended position as when pressed, garment 50 is halved and folded over second lower bar 28 so that upper portion **50*a* and lower portion 50*b* hang together behind first lower bar 24. It is preferred that second lower bar 28 have a slip inhibiting surface texture to better hold garment 50 in place. It is seen here that the length of bars 26 and 28 may be somewhat less than that of bars 22 and 24 but, in any case, should be greater than the greatest folded width of garment 50**.

Figure 4:
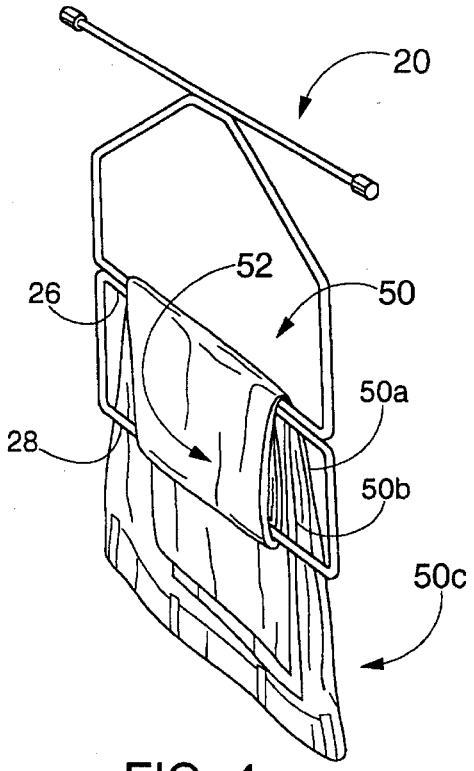
FIG. 4 shows the first step of folding pants on the preferred embodiment of FIG. 1.
Figure 5:
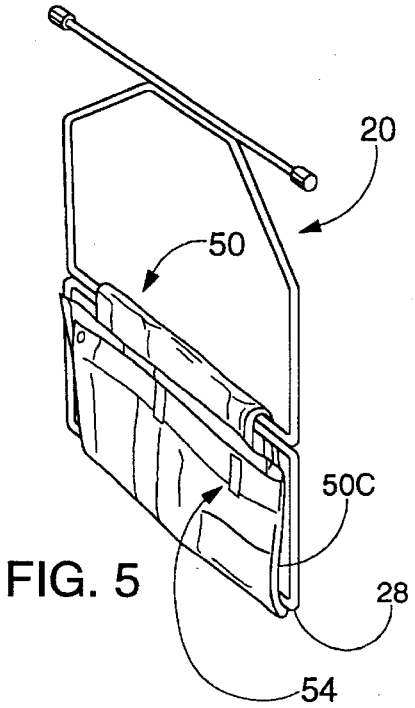
FIG. 5 shows the second step of folding pants on the preferred embodiment of FIG. 1.
Figure 6:
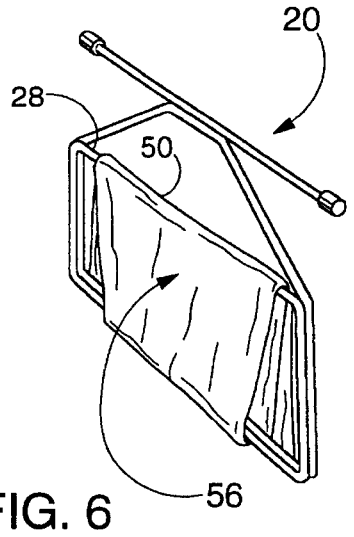
FIG. 6 shows the final step of folding pants on the preferred embodiment of FIG. 1.

In FIG. 4, the second step of folding garment 50 is shown to be accomplished by rotating second lower bar 28 to the lowermost position of FIG. 1, as indicated by arrow 52. Upper portion **50*a* and lower portion 50*b* are thereby folded over themselves in a positive, unwrinkled manner. The spacing of second upper bar 26 and second lower bar 28 must be substantially less than one-half of the length of garment 50 to achieve this result, as can now be seen. Any surplus length 50*c* hanging below second lower bar 28 is then folded over the previously folded portions 50*a* and 50*b* of garment 50, as is indicated by arrow 54 in FIG. 5. The folding of garment 50 is completed by again rotating lower bar 28 to the uppermost position as is indicated by arrow 56 of FIG. 6**.

Figure 7:
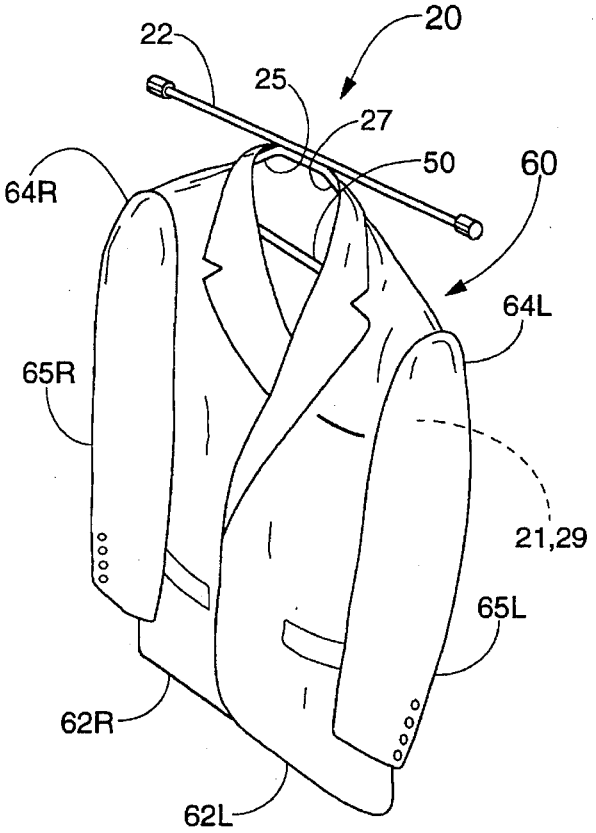
FIG. 7 shows the first step of placing a suit coat or jacket on the preferred embodiment of FIG. 1.

FIG. 7 shows the first step of placing a companion garment 60, which may be either a ladies jacket or a suit coat, on the preferred embodiment 20. Here it is seen that the width of open frames 21 and 29 is adapted to fit within the shoulders 64L and 64R of garment 60. Garment 60 hangs from the shoulder support bars 25 and 27, formed to extend downwardly from first upper bar 22 at an angle of approximately thirty five degrees with respect thereto (an included angle of one hundred ten degrees). This angle is preferably less than forty degrees and greater than the thirty degree supporting angle conventionally found in closet clothes hangers. When garment 60 is hung on shoulder support bars 25 and 27 thusly angled, right hand skirt portion 62R overlaps left hand skirt portion 62L. The overall width across skirt portions 62L and 62R is thus reduced to a dimension equal to or less than that across the shoulder portions 64L and 64R. Overlapping of skirt portions 62L and 62R includes a slight forward rotation of flattened shoulder portions 64L and 64R which, as shown in FIG. 8, also facilitates the folding of the sleeves 65L and 65R across the front of garment 60.

Figure 8:
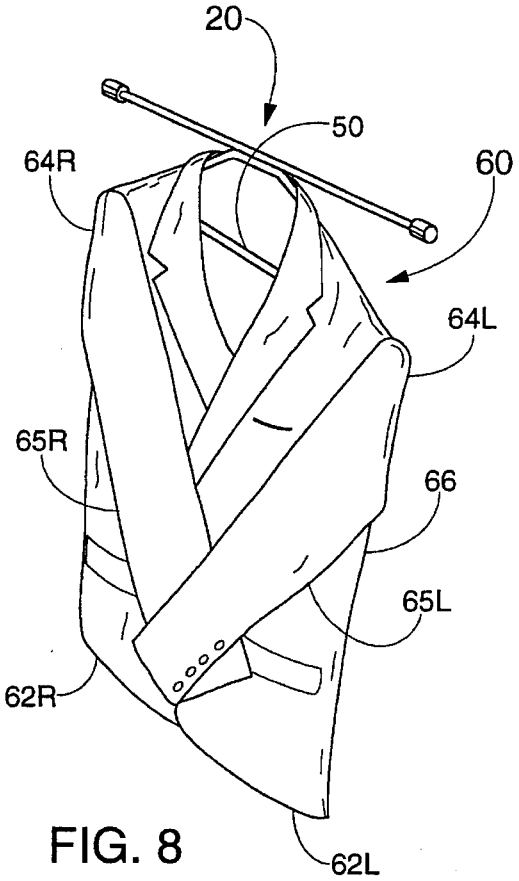
FIG. 8 shows the first step of folding the jacket on the preferred embodiment of FIG. 1.
Figure 9:
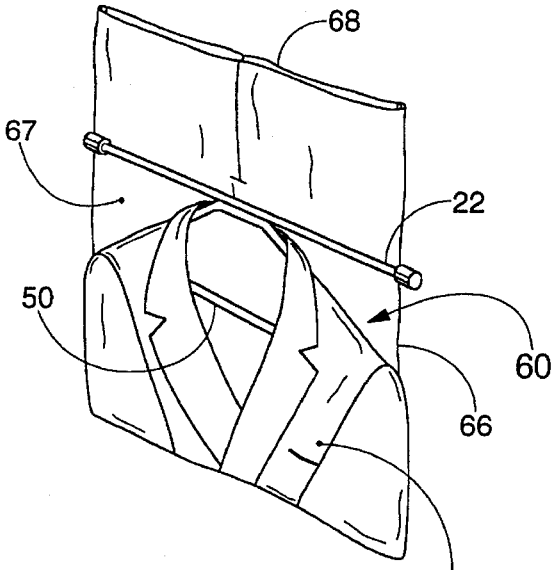
FIG. 9 shows the second step of folding the jacket on the preferred embodiment of FIG. 1.
Figure 10:
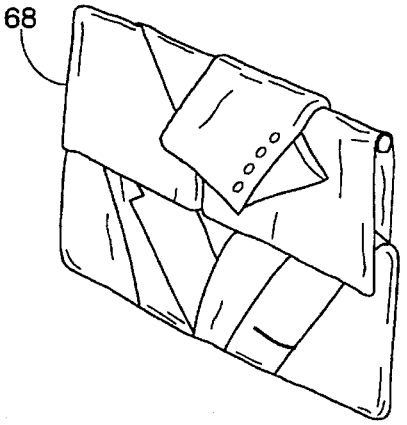
FIG. 10 shows the final step of folding the jacket on the preferred embodiment of FIG. 1.

In FIG. 9 is shown the manner in which garment 60, taken in the position of FIG. 8, is folded. The lower portion 66 of garment 60 is pulled back, so that any wrinkles are stretched out of the upper front portion 63, and folded over garment 50 and upper frame 20. Any wrinkles in the rear panel 67 of garment 60 are brushed out at this point or, alternately, when the support frame of FIG. 2 is used, auxiliary frame 41 is folded down, against rear panel 67 so that rear panel 67 can also be stretched. Generally, the rear of a suit is considered less critical so that use of the auxiliary frame 41 is not crucial. Any surplus length 68 of garment 60 which extends beyond first upper bar 22 is pulled and folded thereover as shown in FIG. 10, upper bar 22 being of a length approximating the flattened width of garment 60.

Figure 11:
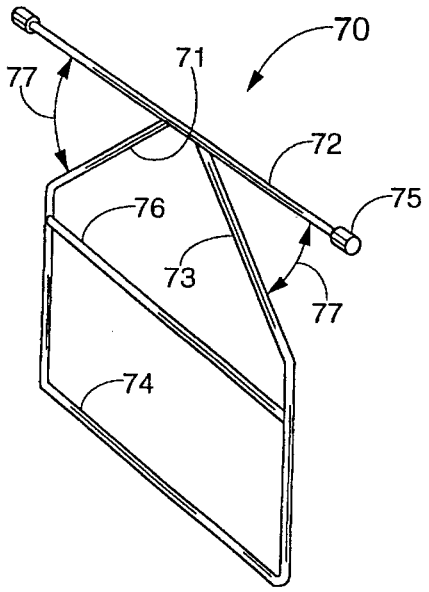
FIG. 11 shows an alternate preferred embodiment of the present invention.

In FIG. 11 is shown the most basic embodiment of the present invention. Here, the open support frame 70 is seen to have upper bar 72, inclined right and left shoulder support bars 71 and 73 respectively, which depend from upper bar 72 at angle 77 and continue on to join lower bar 74. Lower bar 74 is opposed by second parallel lower bar 76 in the two-dimensional structure. The ends of upper bar 72 may be covered with protective caps 75 to prevent snagging fabric, or the ends may be merely rounded for that purpose.

Figure 12:
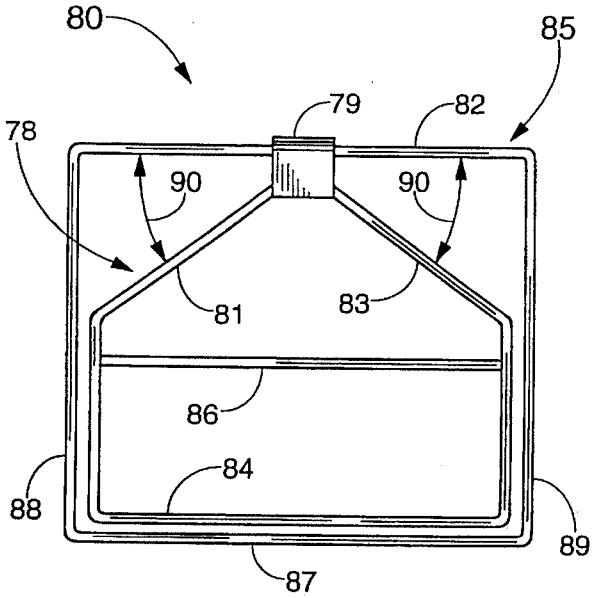
FIG. 12 shows a second alternate preferred embodiment of the invention.
Figure 13:
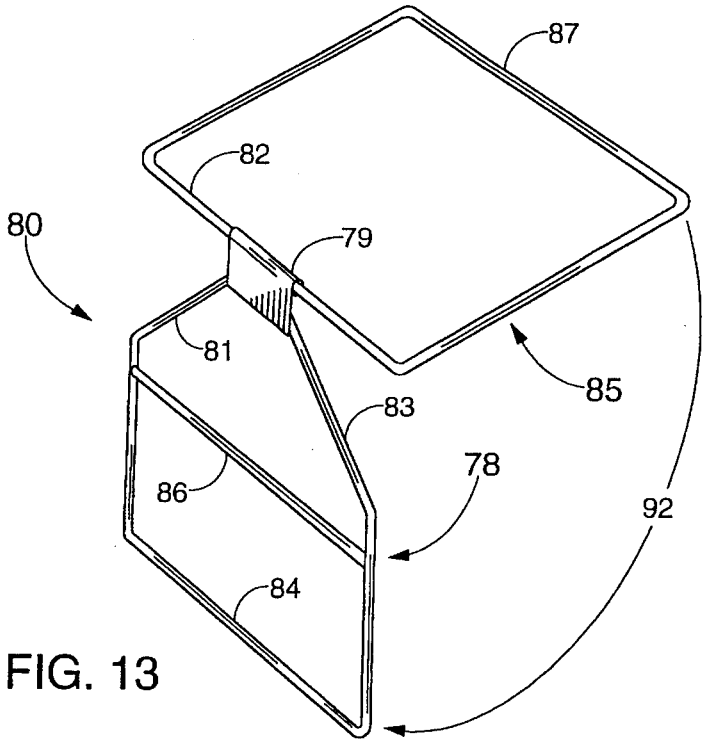
FIG. 13 shows the operation of the second alternate embodiment.

FIG. 12 shows open support frame assembly 80 as a refinement of alternate support frame 70. Inner frame 78, also a two-dimensional structure, is formed in the manner of support frame 70. Inclined right and left shoulder support bars 81 and 83 depend from hinge member 79 at angle 90, and continue on to be joined by lower bar 84. It is preferred that angles 77 and 90 be approximately 35° as previously discussed. Lower bar 84 is opposed by second parallel lower bar 86. Inner frame assembly 78 is pivotally connected to rectangular outer frame 85 by hinge member 79. Outer frame 85 is formed by upper support bar 82 and lower support bar 87 which are joined by right and left side bars 88 and 89. The construction of hinge member 79 is best seen in FIG. 13, where it is noted to loosely enclose the diameter of upper bar 82, allowing pivotal movement as indicated by arrow 92. As can be seen here, lower bars 84 and 87 are closely adjacent and parallel when outer frame 85 is closed into the plane of inner frame assembly 78.

Figure 14:
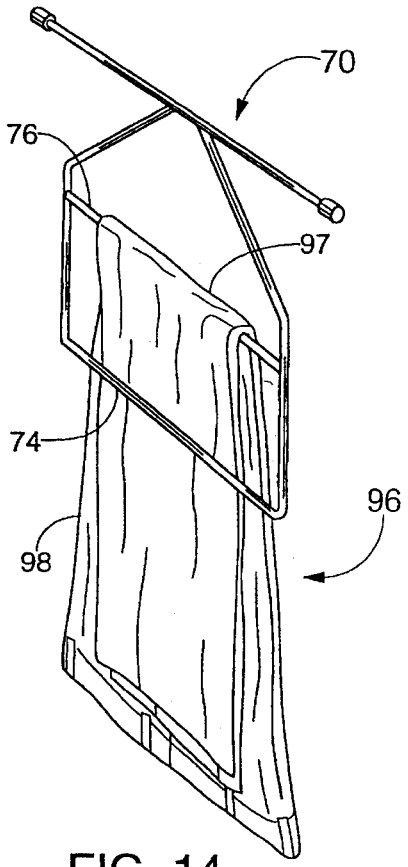
FIG. 14 shows the first step of placing a pair of pants on the preferred embodiment of FIG. 11.
Figure 15:
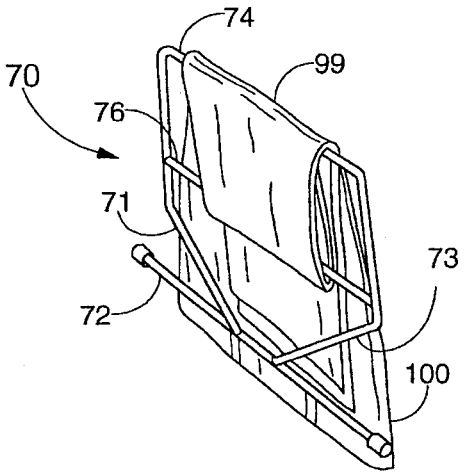
FIG. 15 shows the first step of folding the pants on the preferred embodiment of FIG. 11.
Figure 16:
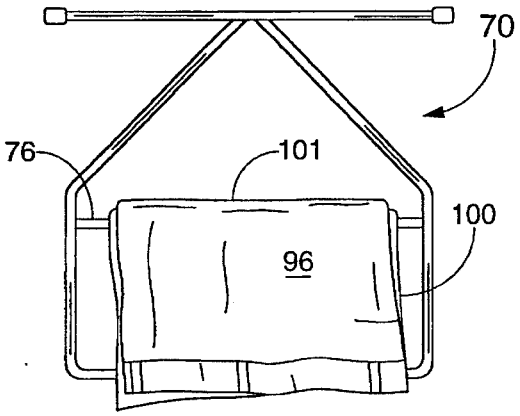
FIG. 16 shows the final second step of folding the pants on the preferred embodiment of FIG. 11.

In FIG. 14, a pair of pants 96 is shown hanging, as pressed, on support frame 70 in much the same way previously shown in FIG. 3. Here, the length of pants 96 is folded in half and hung over lower bar 76 at the fold 97 so that the excess length 98 is outside of, and extending beyond lower bar 74. Support frame 70 is then inverted to make second fold 99 over lower bar 74, as shown in FIG. 15. In this position, the remaining length 100 is gathered and threaded through the opening formed by shoulder bars 71 and 73, upper bar 72 and opposed lower bar 76. When support frame 70 is turned upright, the remaining length 100 of pants 96 is folded around lower bar 76 at third fold 101 as shown in FIG. 16. This gives the same result previously shown in FIG. 6, and a suit coat may then be hung and folded in the same manner shown in FIGS. 7–10. As in FIG. 10, this gives a compactly folded suit with every fold of the length of the pants and the critical front of the coat being made over a bar and supported along its length to prevent wrinkling when packed.

Figure 17:
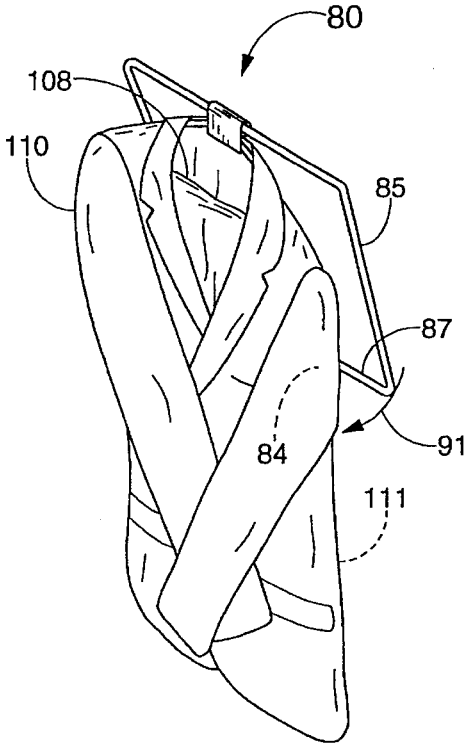
FIG. 17 shows placing of a suit coat on the preferred embodiment of FIG. 12.

FIG. 17 shows a pair of pants 108 folded on support frame 80 in the manner of FIGS. 14–16 with suit Coat 110 hanging over them, flattened and folded in the manner of FIGS. 7 and 8. Lower bar 87 of outer frame 85 is then pivoted in place, as indicated by arrow 91, to bear against the back 111 of coat 110 proximate lower bar 84. The length of coat 110 is then folded over lower bars 87 and 84, in the manner of FIGS. 9 and 10, with the coat back 111 being folded over lower bar 87 so that every fold of the length of the coat is fully supported to prevent wrinkling.

It is to be understood that the present invention is not limited to the disclosed embodiments and may be expressed by rearrangement or modification or substitution of parts or steps without departing from the spirit thereof.

What is claimed is:

1. Apparatus for supporting a suit coat and pants as folded for traveling, the apparatus comprising:

a planar, open frame attached to and below a first straight upper bar of a length approximating the width of the shoulders of the coat, the open frame including a spaced apart first lower bar of substantially equal length and parallel to the first straight upper bar, the spacing between said first straight upper and first lower bars being substantially less than the overall length of the coat;

a second lower bar, parallel to and attached above said first lower bar, spaced so that pants, folded on the length thereof and hanging on said second lower bar at that fold, may be folded at least twice more on their length, around said first and second lower bars so that each fold is made over a bar;

means attached and depending downwardly at an angle from said first straight upper bar for supporting the coat shoulders so that the coat may be folded over said first lower bar and said first straight upper bar in turn, with each fold of the front of the coat being internally supported along its full length by that bar.

2. Apparatus for supporting a suit coat and pants according to claim 1 wherein said second lower bar is attached to said first lower bar for rotation thereabout.

3. Apparatus for supporting a suit coat and pants according to claim wherein said means for shoulder support comprises: a pair of inclined shoulder support bars fitting within the coat and symmetrically depending from said first straight upper bar at the approximate center of the length thereof and substantially in the plane of said first bars.

4. Apparatus for supporting a suit coat and pants according to claim 1 and further comprising:

a third lower bar of a length substantially the same length as said first upper bar and parallel thereto;

means for attaching said third lower bar to said first upper bar for rotation thereabout to a position proximate said first lower bar so as to support the fold of the back of the coat when the coat is folded over said first lower bar.

5. Apparatus for supporting a suit coat and pants according to claim 2 wherein each said shoulder supporting bar forms an angle of between thirty and forty degrees with respect to said first straight upper bar.

6. Apparatus for supporting a suit coat and pants according to claim 4 wherein said second lower bar is attached to said first lower bar for rotation thereabout.

7. Apparatus for supporting a suit coat and pants according to claim 4 wherein said means for shoulder support comprises:

a pair of inclined shoulder support bars fitting within the coat and symmetrically depending from said first straight upper bar at the approximate center of the length thereof so as to be substantially in the plane of said first bars.

8. Apparatus for supporting a suit coat and pants according to claim 7 wherein each said shoulder supporting bar forms an angle of between thirty and forty degrees with respect to said first bars.

9. A method of supporting a suit coat packed for travel comprising the steps of:

providing a flat surface;

providing a suit coat;

providing a planar, open frame attached to and below a first straight upper bar of a length approximating the width of the shoulders of the coat, the open frame including a spaced apart first lower bar of substantially equal length and parallel to the first straight upper bar, the spacing between said first straight upper bar and first lower bar being substantially less than the overall length of the coat;

providing a second lower bar, parallel to and attached above said first lower bar, spaced so that pants, folded on the length thereof and hanging on said second lower at that fold, may be folded at least twice more on their length, around said first and second lower bars, so that each fold is made over a bar;

providing symmetrically inclined shoulder supports attached to the first straight upper bar near the center thereof, being inclined toward said second lower bar;

placing said shoulder support bars within said coat to support the shoulders thereof;

laying said coat down, without wrinkles, with the back thereof on said flat surface;

folding each side of the skirt of said coat in an overlapping manner so that the overall folded width of the skirt is equal to or less than the overall width of the shoulders of said coat;

flattening the arms of said coat to lie over and against the skirt thereof; and folding said coat around each parallel opposed bar in turn, so that the length of said coat is folded at least twice and each fold of the front of said coat is made over a bar which supports the inside of the fold along its full length.

10. The method of supporting a suit coat packed for travel according to claim 9 comprising the additional step of:

providing a third bar parallel to said first bar; and placing said third bar against the back of said coat proximate said second bar so that each fold of the back of said coat is made over a bar which supports the inside of the fold along its full length.

11. The method of supporting a suit coat packed for travel according to claim 9 comprising the additional step of:

arranging said shoulder support bars at an angle of between thirty and forty degrees with respect to said parallel bars.

12. The method of supporting a suit coat packed for travel according to claim 10 comprising the additional step of:

arranging said shoulder support bars at an angle of between thirty and forty degrees with respect to said parallel bars.

13. A method of supporting a suit coat and pair of pants packed for travel comprising the steps of:

placing the pants in the flat position, as pressed, with the length thereof fully extended;

providing an open frame with first and second substantially straight opposed parallel bars;

folding the extended length of the pants transversely;

hanging the fold of the pants over the first bar so that the second opposed bar is outside of the folded length and so that excess folded length extends beyond the second opposed bar;

folding the excess folded length at least one more time over each said bar in turn so that every fold is made over a bar which supports the inside of the fold along its full length;

providing a suit coat;

providing a flat surface;

providing a straight third bar parallel to and spaced apart from said opposed bars and substantially in the plane thereof, the length of said third bar approximating the width of the shoulders of said suit coat;

providing symmetrical shoulder support bars attached to said third bar near the center thereof, with the outer portion of said support bars being inclined downwardly toward said parallel bars;

placing said shoulder support bars within said coat to support the shoulders thereof;

laying said coat down, without wrinkles, with the back thereof on said flat surface;

folding each side of the skirt of said coat in an overlapping manner around said pants so that the overall folded width of the skirt is equal to or less than the overall width of the shoulders of said coat;

flattening the arms of said coat to lie over and against the skirt thereof; and folding said coat around the far opposed bar and said third bar in turn, so that the length of said coat is folded at least twice and each fold of the front of said coat is made over a bar which supports the inside of the fold along its full length.

14. The method of supporting a suit coat packed for travel according to claim 13 comprising the additional step of:

providing a fourth bar parallel to said third bar; and placing said fourth bar against the back of said coat proximate and parallel the far opposed bar so that each fold of the back of said coat is made over a bar which supports the inside of the fold along its full length.

15. The method of supporting a suit coat packed for travel according to claim 13 comprising the additional step of:

arranging said shoulder support bars at an angle of between thirty and forty degrees with respect to said parallel bars.

16. The method of supporting a suit coat packed for travel according to claim 14 comprising the additional step of:

arranging said shoulder support bars at an angle of between thirty and forty degrees with respect to said parallel bars.

* * * * *